US010750876B2

(12) United States Patent
Cammack et al.

(10) Patent No.: US 10,750,876 B2
(45) Date of Patent: Aug. 25, 2020

(54) ADJUSTABLE ORGANIZER

(71) Applicant: ArmsReach Industries LLC, Jackson, WY (US)

(72) Inventors: Joseph R. Cammack, Englewood, CO (US); Robert J. Fuziak, Jr., Jackson, WY (US); David J. Phelps, Tempe, AZ (US)

(73) Assignee: ArmsReach Industries LLC, Jackson, WY (US)

( * ) Notice: Subject to any disclaimer, the term of this patent is extended or adjusted under 35 U.S.C. 154(b) by 296 days.

(21) Appl. No.: 15/912,320

(22) Filed: Mar. 5, 2018

(65) Prior Publication Data

US 2018/0249839 A1 Sep. 6, 2018

Related U.S. Application Data

(60) Provisional application No. 62/467,129, filed on Mar. 4, 2017.

(51) Int. Cl.
*A47C 21/00* (2006.01)
*B65D 1/24* (2006.01)

(52) U.S. Cl.
CPC ..... *A47C 21/00* (2013.01); *B65D 1/24* (2013.01)

(58) Field of Classification Search
CPC ..... A61G 7/0524; A47C 21/00; A47C 7/624; B65D 1/24
See application file for complete search history.

(56) References Cited

U.S. PATENT DOCUMENTS

| | | | |
|---|---|---|---|
| 5,605,235 | A | 2/1997 | Johnson |
| 6,138,301 | A | 10/2000 | Battiston |
| 6,834,403 | B1 | 12/2004 | Elliott |
| 7,296,311 | B1 | 11/2007 | Navarrette |
| 7,642,912 | B2 | 1/2010 | Sholem |
| 7,954,188 | B2 | 6/2011 | House et al. |
| 8,185,987 | B2 | 5/2012 | Keehfus |
| 8,572,784 | B2 | 11/2013 | Keehfus |
| 8,578,528 | B1 | 11/2013 | Heare |
| 2004/0261175 | A1 | 12/2004 | Vlay |
| 2009/0050764 | A1 | 2/2009 | Yankovec et al. |

(Continued)

OTHER PUBLICATIONS

Armsreach on Kickstarter Aug. 2015, The Night holster, All pages—see also youtube, "the nightholster posted in 2015" and Armsreach Twitter date stamps (Year: 2015).*

(Continued)

*Primary Examiner* — David R Hare
*Assistant Examiner* — Adam C Ortiz
(74) *Attorney, Agent, or Firm* — Samuel M. Freund; Cochran Freund & Young LLC

(57) ABSTRACT

An adjustable organizer, for holding useful items and supported between the mattress and box spring of a bed, between couch or chair cushions, or by a bed frame, if available, as examples, is described, Useful items may include magazines, books, mobile telephones, computer tablets, charging devices therefor, drinking water containers, and the like. The adjustable organizer may be disassembled, making it readily storable, and includes a container, which may have multiple compartments, and an open top for providing ready access to the items, first and second planar cylindrical support bars, and planar U-shaped connecting bracket.

8 Claims, 9 Drawing Sheets

(56) References Cited

U.S. PATENT DOCUMENTS

| | | | | |
|---|---|---|---|---|
| 2009/0107937 | A1* | 4/2009 | Watson, Sr. ..... | A47B 23/02<br>211/133.6 |
| 2009/0113631 | A1* | 5/2009 | Palmer ..... | A47C 21/00<br>5/503.1 |
| 2011/0062161 | A1 | 3/2011 | Hassell et al. | |
| 2016/0242564 | A1* | 8/2016 | Cass ..... | A47C 31/00 |

OTHER PUBLICATIONS https://www.amazon.com/remote-control-pocket-organizer; retrieved Oct. 4, 2018 at 2:23 p.m.
https://www.amazon.com/Bed Butler 2.0; retrieved Oct. 4, 2018 at 2:32 p.m.
https://www.crateandbarrel.com/simplehuman-sink-caddy; retrieved Oct. 4, 2018 at 2:46 p.m.
https://www.williams-sonoma.com/products/stainless-steel double caddy; retrieved Oct. 4, 2018 at 2:47 p.m.
https://mindfullproducts.com/productslibrary/bedside-caddy; retrieved Oct. 4, 2018 at 2:48 p.m.
https://www.drake.com/buy-bed-safety-rail-351195; retrieved Oct. 5, 2018 at 11:04 p.m.
https://www.drake.com/buy-sheet-and-blanket-support-310583; retrieved Oct. 5, 2018 at 11:06 p.m.

* cited by examiner

ADJUSTABLE ORGANIZER

CROSS-REFERENCE TO RELATED APPLICATIONS

The present application claims the benefit of U.S. Provisional Patent Application N. 62/467,129 for "BEDSIDE CADDY" by Joseph Cammack et al, which was filed on 04 Mar. 2017, the entire content of which Patent Application is hereby specifically incorporated by reference herein for all that it discloses and teaches.

BACKGROUND

Many bedside storage devices currently known in the art require a support in order to be effectively used. Such supports include a shelf, stand, or a bedside table, as examples. Space around beds is often limited, which may prevent convenient access to these storage devices. Depending on the design and location of the support, accessibility to the contents of the storage device may be difficult for someone laying on the bed, especially if bedridden. Moreover, many existing storage devices are supported between a bed mattress and box spring in the absence of a frame, thereby requiring a user to reach below the surface of a mattress in order to locate items to be retrieved.

SUMMARY

To achieve the purposes of the embodiments of the present invention, as embodied and broadly described herein, the adjustable organizer hereof includes: a container comprising a base having an upper surface and a lower surface; two parallel, spaced-apart side members integrally formed with or attached perpendicularly to the upper surface of the base, with each side member having a first chosen height; a first sleeve; a second sleeve parallel to and spaced-apart from the first sleeve, wherein the first sleeve and the second sleeve are integrally formed with or attached to the lower surface of the base perpendicularly to the side members, each of the first sleeve and the second sleeve having a cylindrical hole terminating at the open end thereof; wherein the container has an open top; a first cylindrical support bar having a forward portion with a first open end adapted to be rotatably inserted into the hole in the first sleeve, a first right-angle bend following the forward portion, a central portion having a length greater than the first chosen height, followed by a second right angle bend in the same plane as the first right angle bend and in the opposite direction thereto, and an end portion having a chosen length and a second open end; a second cylindrical support bar having a forward portion with a first open end adapted to rotatably fit into the hole in the second sleeve, a first right-angle bend following the forward portion, a central portion having a length greater than the first chosen height, followed by a second right angle bend in the same plane as the first right angle bend and in the opposite direction thereto, and an end portion having a chosen length and a second open end; and a planar, U-shaped connecting bracket having a first arm and a second arm parallel to and spaced-apart from the first arm, each of the first arm and the second arm having an open end and a cylindrical bore therein terminating at the open end thereof, capable of rotatably receiving the second open end of the end portion of one of the first cylindrical bar or the second cylindrical bar.

Benefits and advantages of embodiments of the present invention include, but are not limited to, providing an adjustable organizer for holding useful items and supported between the mattress and box spring of a bed, between couch or chair cushions, as examples, or by a bed frame, if available, where useful items may include magazines, books, mobile telephones, computer tablets, charging devices therefor, drinking water containers, and the like. The adjustable organizer may be disassembled, making it readily storable.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 2B is a schematic representation of a top view of an embodiment of the present multicompartment container, illustrating a compartment for a USB charger, while

DETAILED DESCRIPTION

Briefly, the present invention includes an adjustable organizer for holding useful items and supported between the mattress and box spring of a bed, between couch or chair cushions, or by a bed frame, if available, as examples. Useful items may include magazines, books, mobile telephones, computer tablets, charging devices therefor, drinking water containers, and the like. The adjustable organizer may be disassembled, making it readily storable.

Figure 1A:
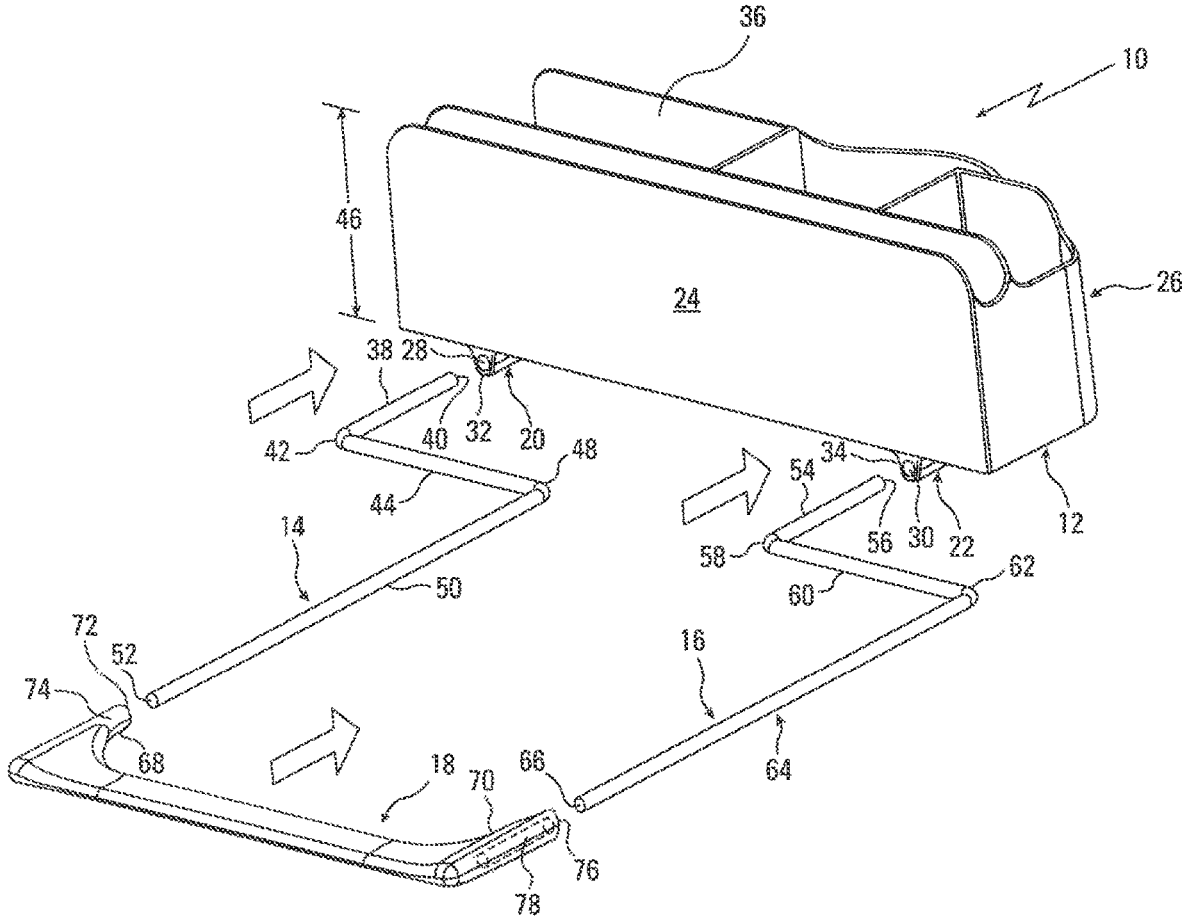
FIG. 1A is a schematic representation of a disassembled top, rear perspective view of an embodiment of the present adjustable organizer, illustrating the multicompartment container, the first planar cylindrical support bar and the second planar cylindrical support bar, the planar U-shaped connecting bracket, parallel, and spaced-apart sleeves, perpendicular to the parallel, spaced-apart side members.

Reference will now be made in detail to the present embodiments of the invention, examples of which are illustrated in the accompanying drawings. In the FIGURES, similar structure will be identified using identical reference characters. It will be understood that the FIGURES are for the purpose of describing particular embodiments of the invention and are not intended to limit the invention thereto. Turning now to FIG. 1A, shown is a schematic representation of a disassembled top, rear perspective view of an embodiment of adjustable organizer, 10, of the present invention, illustrating multicompartment container, 12, first planar cylindrical support bar, 14, second planar cylindrical support bar, 16, and planar U-shaped connecting bracket, 18. Also illustrated are parallel, spaced-apart sleeves, 20, and 22, perpendicular to parallel, spaced-apart side members 24 and 26 of multicompartment container 12, having cylindrical bores, 28, and 30, respectively, therein, terminating at open ends, 32, and 34, thereof, respectively. As may be observed from FIG. 1A, container 12 has open top 36 for providing ready access to the items held by container 12.

First cylindrical support bar 14 is illustrated as having forward portion, 38, with open end, 40, adapted to rotatably fit into cylindrical bore 28 of sleeve 20, first right-angle bend, 42, central portion, 44, having a chosen length typical equal to or greater than height, 46, of side member 24, second right-angle bend, 48, disposed in the same plane as first right-angle bend 42, and in the opposite direction thereto, end portion, 50, and second open end, 52. Second cylindrical bar 16, identical to first cylindrical bar 14, has identical components 54, 56, 58, 60, 62, 64, and 66, respectively, with open end 56 adapted to rotatably fit into cylindrical bore 30 of sleeve 22.

Planar, U-shaped connecting bracket is shown having first arm, 68, and second arm, 70, spaced-apart therefrom and parallel thereto. First arm 68 has open end, 72, and cylindrical bore, 74, adapted to rotatably receive end 52 of end portion 50 of cylindrical support bar 14, and opening to open end 72, and second arm 70 has open end, 76, and cylindrical bore, 78, adapted to rotatably receive open end 66 of end portion 64 of second cylindrical support bar 16, and opening to open end 76. It should be mentioned that U-shaped connecting bracket may have several shapes in addition to the traditional U, including rectangular and V-shape, as examples.

Figure 1B:
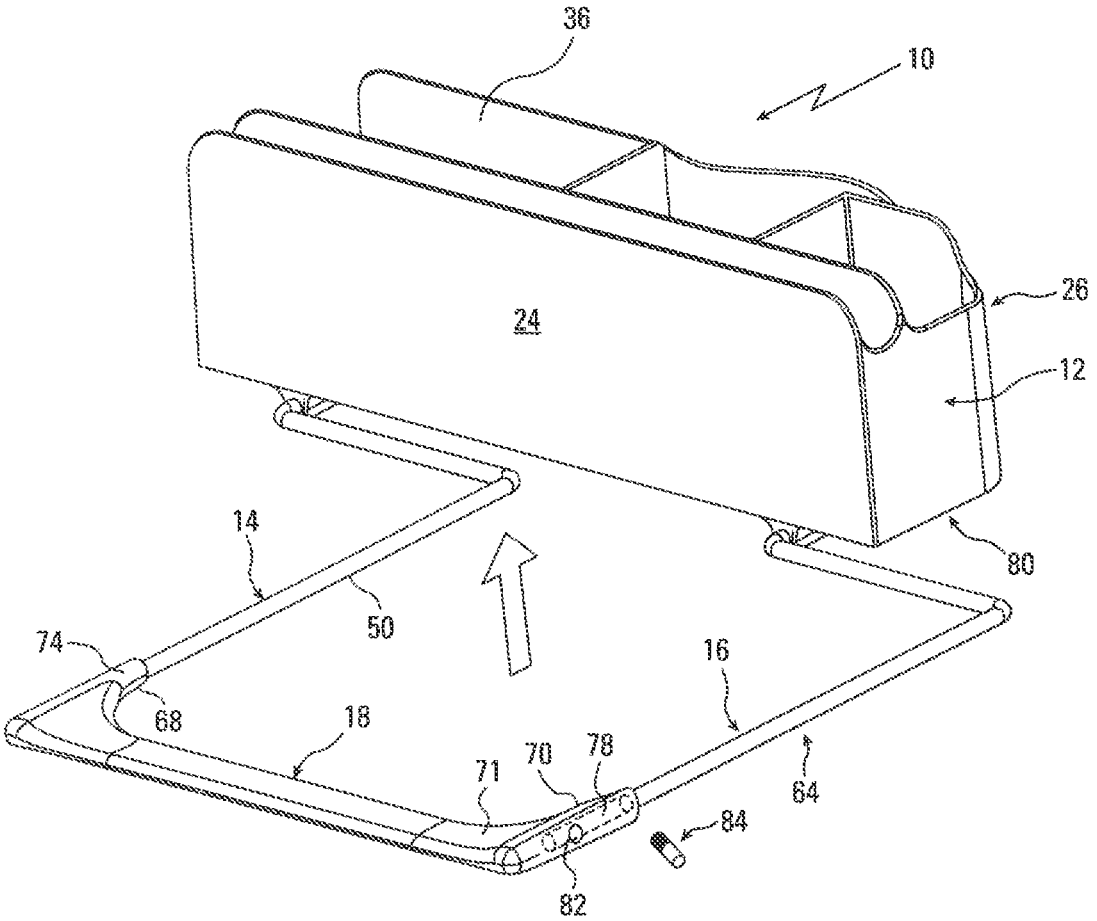
FIG. 1B is a schematic representation of the assembled adjustable organizer illustrated in FIG. 1A, hereof, along with one manner in which chosen resistance to rotation of the first and second cylindrical support bars may be provided.

FIG. 1B is a schematic representation of assembled adjustable organizer 10 illustrated in FIG. 1A, showing base, 80, spaced-apart side members 24 and 26 and sleeves 26, and 28, all integrally formed with or attached to base 80, of multicompartment container 12. In some applications, it is desirable to provide a chosen resistance to rotation for the received end portion of one or both of first cylindrical support bar 14 and second cylindrical support bar 16. One way to achieve this effect is to introduce threaded hole, 82, through arm 70 opening to outside surface, 71, of U-shaped connection bracket 18 perpendicular to cylindrical bore 78 therein, in the plane thereof; and to provide at least one set screw, 84, adapted for being screwed into one of the threaded holes, and contacting end portion 64 of second cylindrical support bar 16. As stated, a similar threaded hole might be introduced into arm 68 of U-shaped connection bracket 18, and a second set screw provided, or two sets of threaded holes and set screws used. For convenience, screws having knurled knobs for easy tightening might be employed.

Another way to achieve this effect would be to introduce a threaded hole, 85, perpendicular to the cylindrical bore of either or both of first sleeve 20 and second sleeve 22 of container 12, opening to the outside surface thereof, 87, 89, respectively, of each of the sleeves (FIG. 2C),and providing at least one set screw, 91, adapted for being screwed into one of the threaded holes for contacting received forward portion 38 or 54 of at least one of first cylindrical support bar 14 and second cylindrical support bar 16, respectively.

Figure 1C:
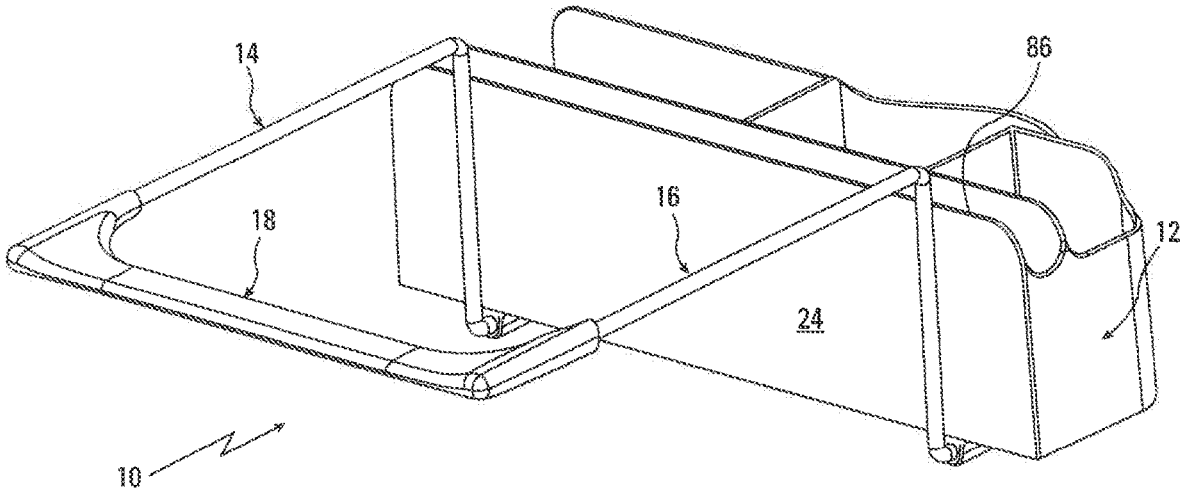
FIG. 1C is a schematic representation of a top, rear perspective view of the adjustable organizer hereof shown in FIG. 1B, where the cylindrical support bars are rotated such that the planar U-shaped connecting bracket is positioned toward the top of one of the side members of the container, while FIG. 1D, which is a schematic representation of a top, front perspective view of the adjustable organizer being supported by a mattress and box spring, between which end portions of the cylindrical support bars and U-shaped connection bracket are inserted.
Figure 1D:
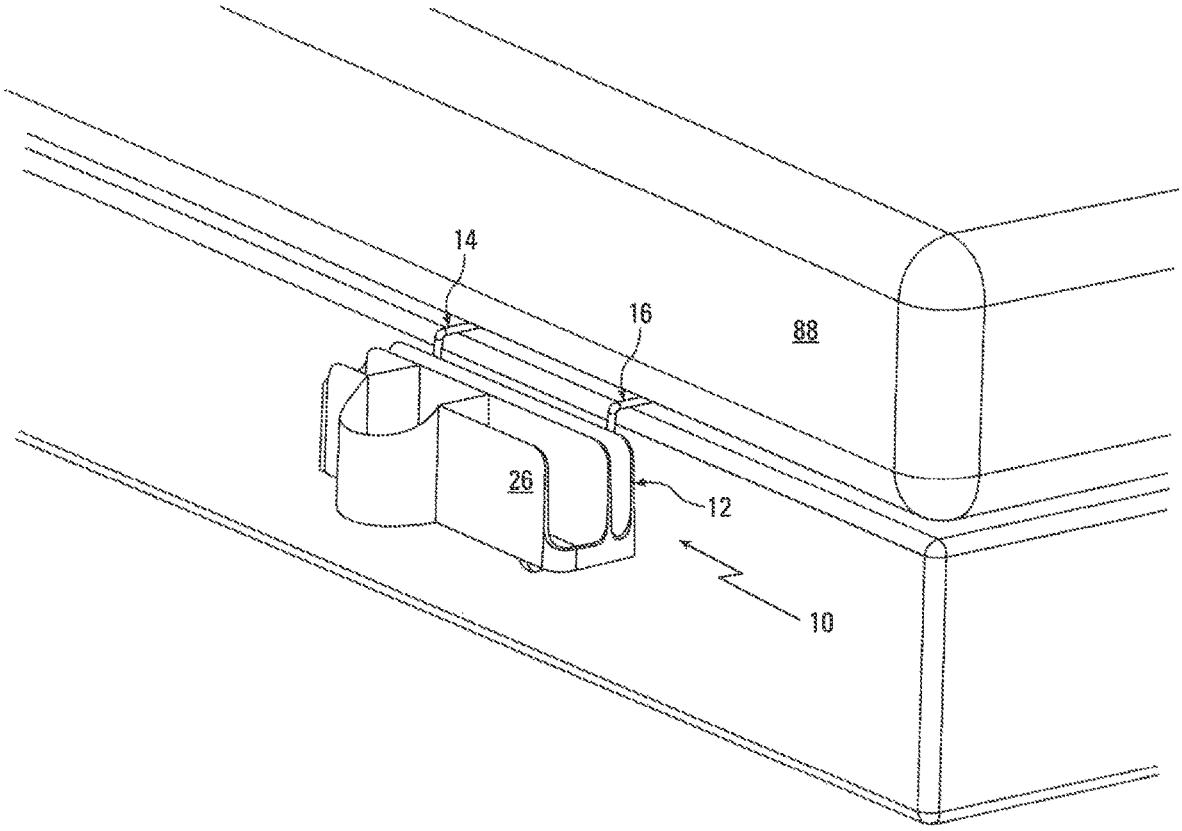
FIG. 1E is a schematic representation of a top, rear perspective view of the adjustable organizer hereof shown in 1B, where the cylindrical support bars are rotated such that the planar U-shaped connecting bracket is positioned below the bottom of the container such that the bottom is supported by the top portion of a frame, which is shown surrounding the box spring, with cylindrical support bars and U-shaped connecting bracket being further stabilized between the box spring and a mattress (not shown in FIG. 1E), while FIG. 1F, which is a schematic representation of a top, front perspective view of the adjustable organizer being supported on the top surface of the frame.

FIG. 1C is a schematic representation of a top, rear perspective view of apparatus 10 hereof shown in FIG. 1B, where cylindrical support bars 14 and 16 are rotated such that planar U-shaped connecting bracket 18 is positioned toward top, 86, of side member 24 of container 12. As may be observed from FIG. 1D, which is a schematic representation of a top, front perspective view of adjustable organizer 10 being supported by mattress, 88, and box spring, 90, between which end portions 50 and 64 of cylindrical support bars 14 and 16, respectively, and U-shaped connection bracket 18, to which cylindrical support bars 14 and 16 are rotatably connected, are inserted. It should be mentioned that if cylindrical support bars 14 and 16 are rotated, container 12 may be raised a chosen distance above box spring 90 for easier access by a user laying on mattress 88.

Figure 1E:
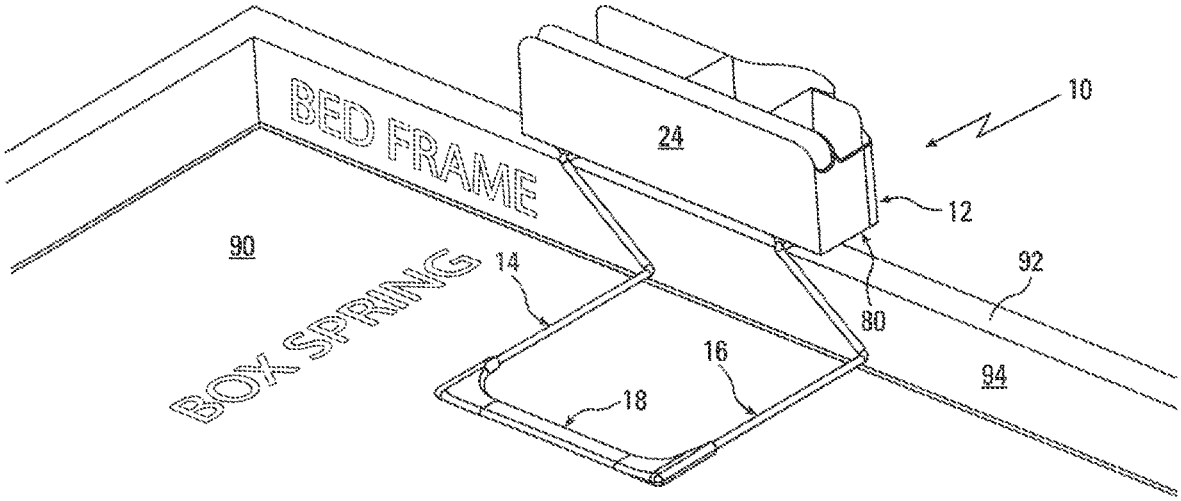
Figure 1F:
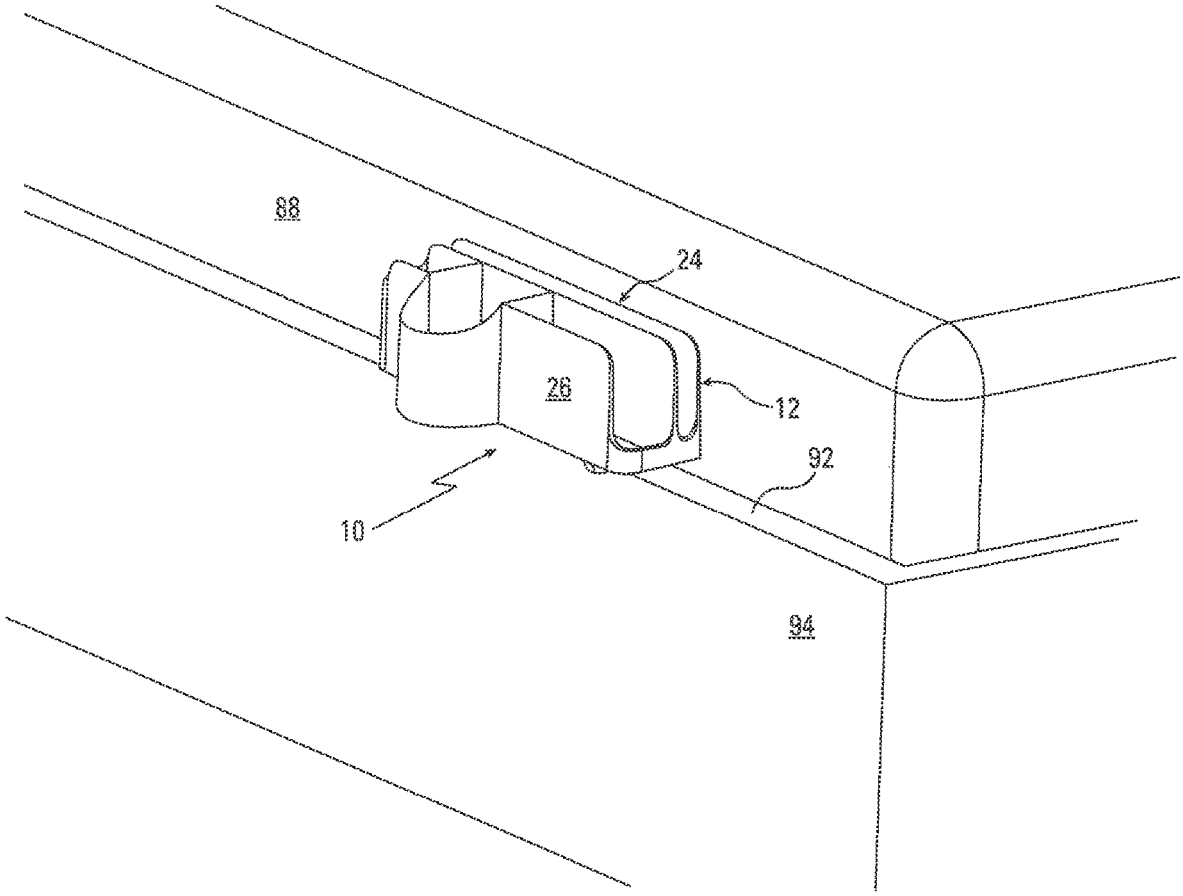

FIG. 1E is a schematic representation of a top, rear perspective view of apparatus 10 hereof shown in FIG. 1B, where cylindrical support bars 14 and 16 are rotated such that planar U-shaped connecting bracket 18 is positioned below bottom 80, of container 12, such that bottom 80 is supported by top portion, 92, of frame, 94, which is shown surrounding box spring 90. Cylindrical support bars 14 and 16 and U-shaped connecting bracket 18 are further stabilized between box spring 90 and mattress 88 (not shown in FIG. 1E). As may be observed from FIG. 1F, which is a schematic representation of a top, front perspective view of adjustable organizer 10 being supported on top surface 92 of frame 94.

Figure 2C:
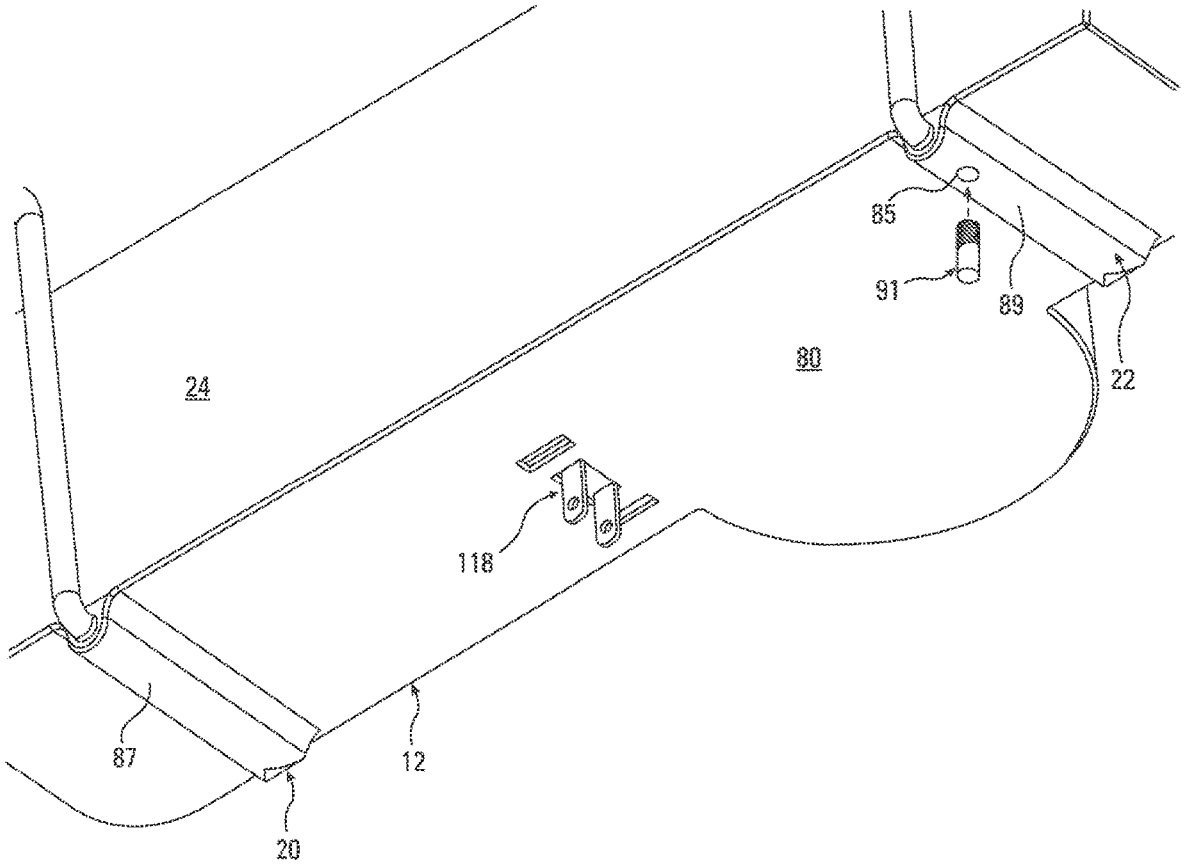
FIG. 2C is a schematic representation of a bottom perspective view of the multicompartment container showing a hole in the bottom thereof for permitting the ac connector of charger to be accessible for connection to an ac line cord (not shown in FIG. 2C).
Figure 2A:
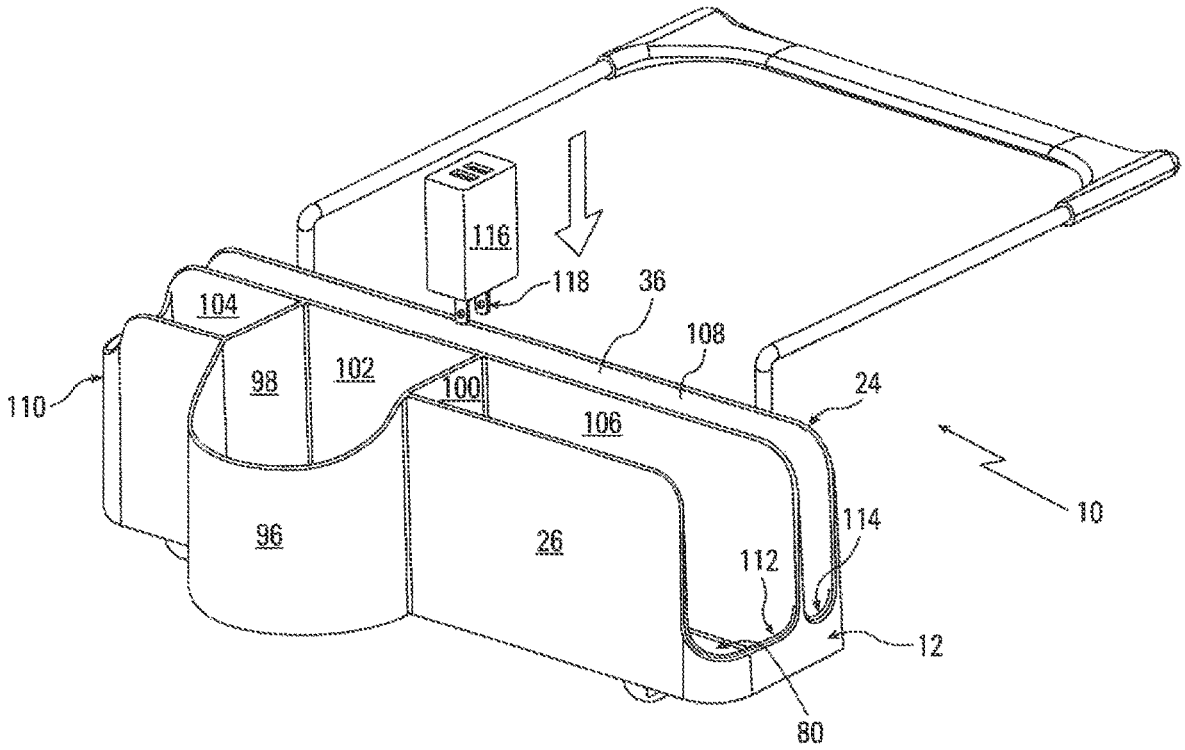
FIG. 2A is a schematic representation of a front, top perspective view of the present adjustable organizer illustrating an example of compartments for the multicompartment container. In addition to an open top, and side members, shown is a beverage container holder, and walls, which with the bottom member form compartments for holding other items.

FIG. 2A is a schematic representation of a front, top perspective view of an embodiment the present adjustable organizer 10 illustrating an example of compartments for multicompartment container 12. In addition to open top 36, and side members 24 and 26, shown is beverage container holder, 96, for holding cups, cans, mugs, bottles, and the like, having walls, 98, 100, and 102, which, with bottom member 80 form compartments 104, 106, and 108, for holding other items, such as mobile telephones, computer notepads, magazines, books, as examples, Additional walls 110, 112, and 114, having various heights may be added to prevent valuable items from falling out of container 12. Such walls may be attached to or integrally formed with the side members 24 and 26 and base 80, as appropriate. Shown also is USB charger 116, having ac connector, 118, which, as will be shown below, has its own compartment. Clearly, multicompartment container 12 may have fewer or a greater number of compartments and compartments having different orientations with respect to one another.

Figure 2B:
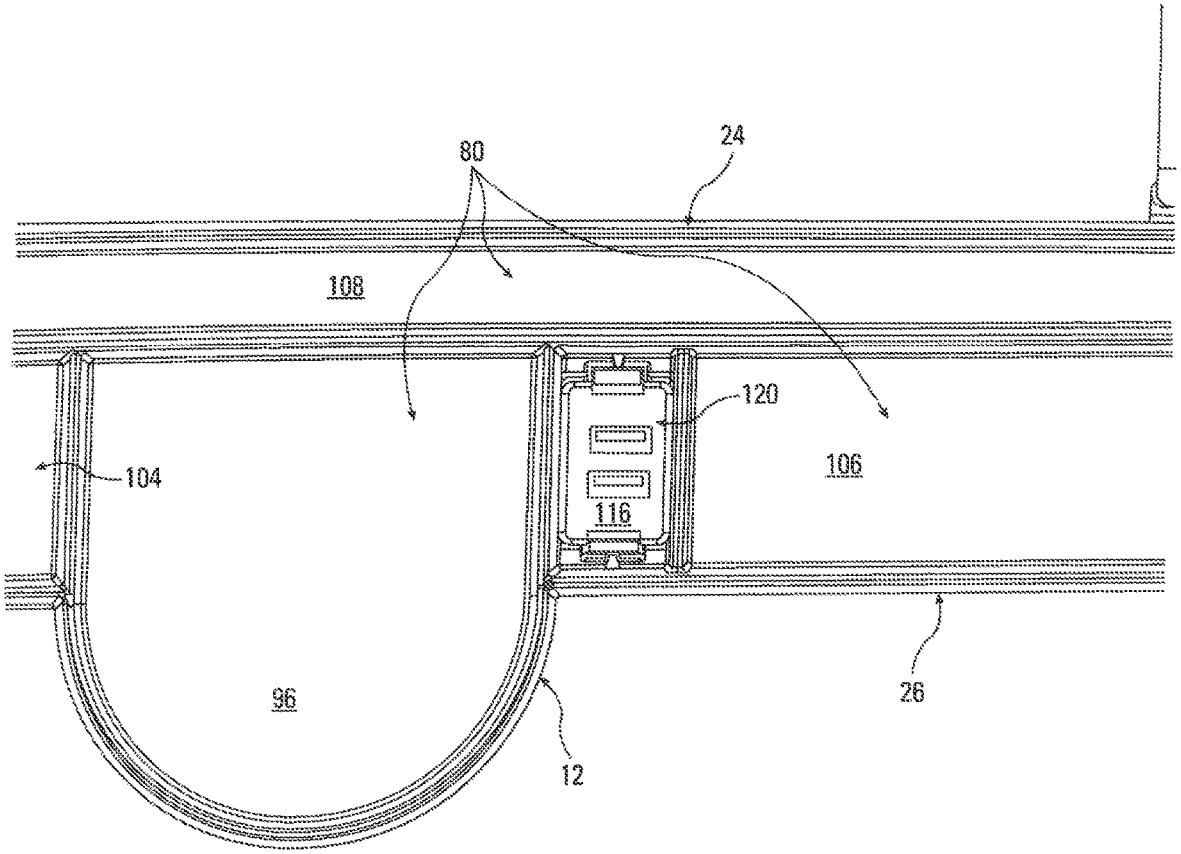

FIG. 2B is a schematic representation of a top view of an embodiment of the present multicompartment container 12, illustrating a compartment, 120, for USB charger 116, while FIG. 2C is a schematic representation of a bottom perspective view of multicompartment container 12 showing hole, 122, in bottom 80 for permitting ac connector 118 of charger 116 to be accessible for connection to an ac line cord (not shown in FIG. 2C).

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An adjustable organizer, comprising:

a container comprising a base having an upper surface and a lower surface; two parallel, spaced-apart side members integrally formed with or attached perpendicularly to the upper surface of the base, with each side member having a first chosen height; a first sleeve; a second sleeve parallel to and spaced-apart from the first sleeve, wherein the first sleeve and the second sleeve have an outside surface, and are integrally formed with or attached to the lower surface of the base perpendicularly to the side members, each of the first sleeve and the second sleeve having a cylindrical hole terminating at the open end thereof; wherein the container has an open top;

a first cylindrical support bar having a forward portion with a first open end adapted to be rotatably inserted into the hole in the first sleeve, a first right-angle bend following the forward portion, a central portion having a length greater than the first chosen height, followed by a second right angle bend in the same plane as the first right angle bend and in the opposite direction thereto, and an end portion having a chosen length and a second open end;

a second cylindrical support bar having a forward portion with a first open end adapted to rotatably fit into the hole in the second sleeve, a first right-angle bend following the forward portion, a central portion having a length greater than the first chosen height, followed by a second right angle bend in the same plane as the first right angle bend and in the opposite direction thereto, and an end portion having a chosen length and a second open end; and a planar, U-shaped connecting bracket having a first arm and a second arm parallel to and spaced-apart from the first arm, and an outside surface, each of the first arm and the second arm having an open end and a cylindrical bore therein terminating at the open end thereof, capable of rotatably receiving the second open end of the end portion of one of the first cylindrical bar or the second cylindrical bar; whereby the first cylindrical bar and the second cylindrical bar are rotatable such that said planar, U-shaped connecting bracket is adjustable relative to the lower surface of the base of said container.

2. The adjustable organizer of claim 1, wherein said container comprises a multicompartment container.

3. The adjustable organizer of claim 2, wherein at least one of the compartments of said multicompartment container comprises a cup holder.

4. The adjustable organizer of claim 2, wherein at least one of the compartments of said multicompartment container comprises a bottle holder.

5. The adjustable organizer of claim 2, wherein one of the compartments of said multicompartment container comprises a USB charger holder having an ac connector accessible through the base.

6. The adjustable organizer of claim 1, wherein said adjustable bedside organizer is constructed from materials chosen from plastic, wood, and metal, and combinations thereof.

7. The adjustable organizer of claim 1, wherein at least one of the first arm and the second arm of said U-shaped bracket further comprises a threaded hole perpendicular to the cylindrical bore therein, in the plane of the U-shaped bracket, and opening to the outside surface of the U-shaped bracket; and at least one set screw adapted for being screwed into one of the threaded holes, for providing a chosen resistance to rotation for the received end portion of at least one of the first cylindrical bar and the second cylindrical bar.

8. The adjustable organizer of claim 1, wherein at least one of the first sleeve and the second sleeve of said container further comprises a threaded hole perpendicular to the cylindrical bore therein, opening to the outside surface of each of said sleeves; and at least one set screw adapted for being screwed into one of the threaded holes, for providing a chosen resistance to rotation for the received forward portion of at least one of the first cylindrical bar and the second cylindrical bar.

* * * * *